US008136814B2

(12) United States Patent
Segebarth

(10) Patent No.: US 8,136,814 B2
(45) Date of Patent: Mar. 20, 2012

(54) PREDETERMINED BONUS ENHANCEMENT FOR GAME CARD GAME

(75) Inventor: Larry S. Segebarth, Frisco, TX (US)

(73) Assignee: International Gamco, Inc., Omaha, NE (US)

( * ) Notice: Subject to any disclaimer, the term of this patent is extended or adjusted under 35 U.S.C. 154(b) by 35 days.

(21) Appl. No.: 11/897,702

(22) Filed: Aug. 31, 2007

(65) Prior Publication Data

US 2009/0058006 A1 Mar. 5, 2009

(51) Int. Cl.
*A63F 3/06* (2006.01)

(52) U.S. Cl. ..... 273/139; 273/269; 283/901; 283/903

(58) Field of Classification Search ..... 273/139, 273/269; 283/901, 903
See application file for complete search history.

(56) References Cited

U.S. PATENT DOCUMENTS

| | | | | |
|---|---|---|---|---|
| 5,046,737 | A | 9/1991 | Fienberg | |
| 5,407,200 | A | 4/1995 | Zalabak | |
| 5,562,284 | A | 10/1996 | Stevens | |
| 5,671,921 | A * | 9/1997 | Quinlan | 273/139 |
| 5,743,524 | A * | 4/1998 | Nannicola | 273/139 |
| 5,931,468 | A | 8/1999 | Orolin | |
| 5,934,671 | A * | 8/1999 | Harrison | 273/139 |
| 6,309,298 | B1 * | 10/2001 | Gerow | 463/20 |
| 6,390,916 | B1 * | 5/2002 | Brown | 463/17 |
| 6,447,395 | B1 | 9/2002 | Stevens | |
| 6,612,576 | B1 * | 9/2003 | Stancik et al. | 273/139 |
| 6,824,135 | B2 * | 11/2004 | Stancik | 273/139 |
| 6,880,824 | B2 * | 4/2005 | Thinnes | 273/139 |
| 2003/0030211 | A1 * | 2/2003 | Brown | 273/139 |
| 2003/0116916 | A1 * | 6/2003 | Cherry | 273/292 |

* cited by examiner

*Primary Examiner* — Benjamin Layno
(74) *Attorney, Agent, or Firm* — Stinson Morrison Hecker LLP

(57) ABSTRACT

This invention relates to a predetermined bonus feature for use in conjunction with a designated underlying game of chance, wherein the individual game card and master game card or master bonus game card include symbols that predetermine and identify which player(s) is eligible to win the bonus prize upon the occurrence of another event. A predetermined winning bonus symbol on a master game card or master bonus game card made known prior to or after conclusion of play of the designated underlying game. Players who have a symbol on their individual game card that matches the predetermined winning bonus symbol know, in advance, that they are eligible to participate to win the bonus prize. The winner(s) of the designated underlying game will win the bonus prize if s/he is able to match a symbol on the individual game card with the winning bonus symbol.

12 Claims, 8 Drawing Sheets

PREDETERMINED BONUS ENHANCEMENT FOR GAME CARD GAME

CROSS-REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

This invention relates generally to the field of gaming. In particular, the invention is directed to a novel enhancement for an underlying game card game such as pull tab games, seal card games, bingo-event games, or down-line bingo-event games, wherein a game card is provided to a player and wherein said game card predetermines and identifies whether the player is eligible to win a bonus prize upon the occurrence of another event, such as winning a designated underlying game. The invention further includes a predetermined winning bonus symbol that is displayed on a master game card or bonus master game card and is made known to all players prior to or after completion of play of the designated underlying game. As such, the player knows in advance that, if at least one of the designated play results on their game card matches a winning bonus symbol, s/he is eligible to win or share the bonus prize. A player who wins the designated underlying game may then win the bonus prize by matching the winning bonus symbol to a designated play result on their game card.

Game card games provide both a popular form of entertainment to players of the game and a source of income to providers of the cards. These providers include state governmental bodies, charities, and private organizations. The providers may sell the cards, or they may distribute them as promotions.

For players, the greater the entertainment value, the more they enjoy playing the game. For providers, the greater the entertainment value, the more effective the game card game is in generating card sales or promotional affects. For providers selling the cards in conjunction with other products or services, the entertainment value also provides an incentive to bring in players, who in turn use the other products or services.

As a result, there is a need for a gaming system which can be played in conjunction with various games of chance such as pull tab and seal card games, as well as the game of bingo, related down-line games, and the like, which can increase player excitement and attendance during the game play period.

BRIEF SUMMARY OF THE INVENTION

The present invention provides a novel enhancement for use with various game card games such as pull tab and seal card games, as well as bingo-event games, down-line variations thereof, and the like. The invention provides enhanced entertainment to players of the game card game by predetermining and identifying, on a master game card, which player (s) is eligible to win a bonus prize should another event occur, such as the player winning a designated underlying game. Since the winning bonus symbol is made known prior to the conclusion of the designated underlying game or games, the potential winners of the bonus prize are known prior to or during play of an underlying game. The bonus prize is won by a winner of the designated underlying game who is able to match a predetermined designated play result with a predetermined and known winning bonus symbol.

The invention includes one or more individual game cards. Each game card includes one or more designated play results which may be hidden, initially, from view or otherwise not accessible to players for inspection. The game cards are sold or otherwise distributed to players in a manner such that the player is not able to select a specific designated play result due to concealment of the designated play result. As such, the designated play result is revealed at some point after the game cards are distributed.

The invention also includes at least one master game card. The master game card contains at least one winning bonus symbol which may or may not be concealed, initially. Alternatively, it is within the scope of the present invention, to have a master bonus game card that is separate from the master game card of the underlying game. In such case, the master game card for the underlying game could contain symbols corresponding to the underlying game or games and the master bonus game card would contain at least one winning bonus symbol. Likewise, the winning bonus symbol on the master bonus game card may or may not be concealed, initially.

Only a winner of the "designated underlying game" may win the bonus prize. In order to win the bonus prize, the designated underlying game winner or winners must be able to match a designated play result on their individual game card with the winning bonus symbol on the master game card or master bonus game card. As such, the winner or winners of the designated underlying game automatically know if they have won the bonus prize because the winning bonus symbol is predetermined and has been made known prior to or after completion of the designated underlying game.

To summarize one exemplary embodiment of the present invention, all individual game cards are distributed and the predetermined winning bonus symbol is made known to all players. The manufacturer or gaming manager indicates which specific underlying game will be the designated underlying game with which the bonus prize feature is identified, and thereby which play results may be the designated play results identified with the bonus prize feature of the present invention. Players that have a designated play result on their game card that matches the winning bonus symbol may win the bonus prize. At this point, excitement builds as the players determine who may potentially win the bonus prize. The designated underlying game or games are played to their conclusion and one or more winners of the designated underlying game are determined and the associated prize, if any, is awarded. The bonus prize of the present invention will be awarded if the winner or winners of the designated underlying game have a designated play result that matches the winning bonus symbol. This order of play is exemplary only, and it is within the scope of the present invention to reveal the winning bonus symbol at any point prior to the conclusion of play of the designated underlying game. Any game card game known in the art, such as, pull tab, seal card, bingo-event, or down-line bingo-event games, may be the designated underlying game. Likewise, any number of games may be part of the gaming system of the invention.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION

Figure 1:
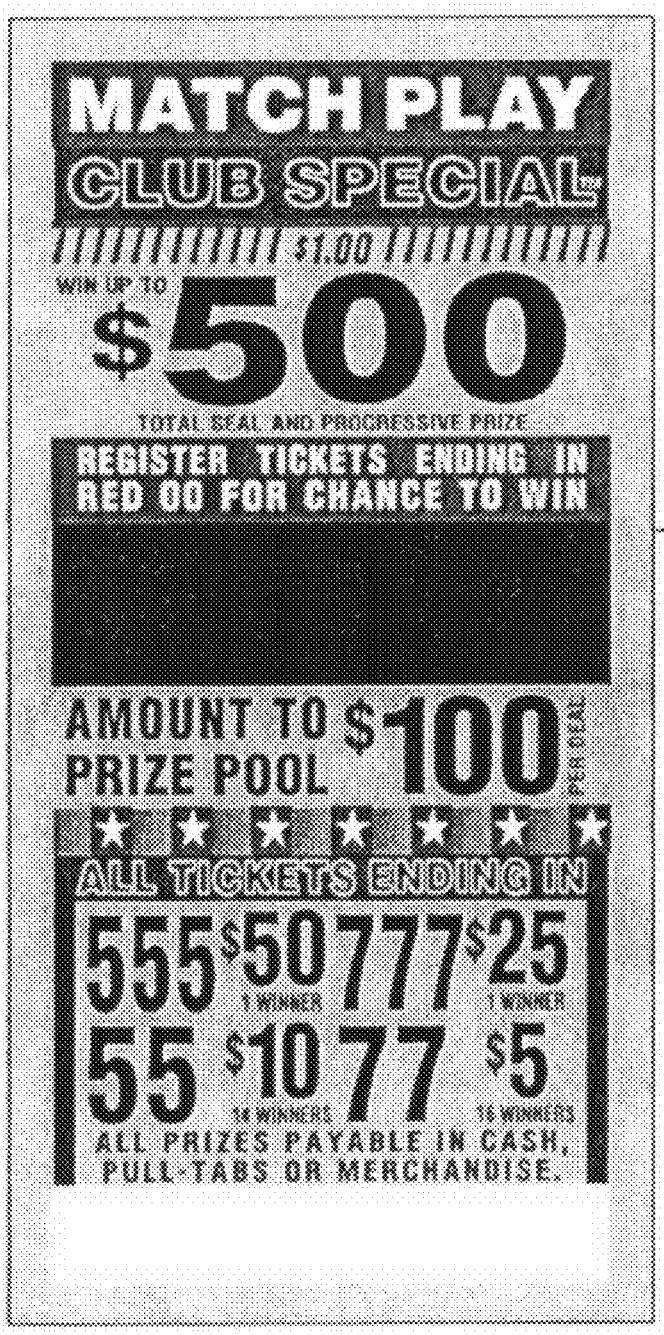
FIG. 1 is a front view of an exemplary game card used in one embodiment of the present invention, where the underlying game is a seal card game.

The present invention is directed to a novel enhancement to a game card game for use with various game card games such as pull tab and seal card games, as well as bingo-event games, down-line bingo-event games, and the like. More specifically, the invention provides enhanced entertainment to players of the game card game by predetermining and identifying, on a master game card, which player is eligible to win a bonus prize should another event occur, such as the player winning a designated underlying game. The potential winners of the bonus prize are known prior to or during play of the designated underlying game, as the winning bonus symbol is made known prior to the conclusion of the designated underlying game or games. The bonus prize is won by a winner of a designated underlying game who is able to match a designated play result with a predetermined and known winning bonus symbol.

Definitions. The present invention employs the following definitions:

"Bonus prize" as used herein refers to the prize that may be won by a winner of a designated underlying game who is able to match a designated play result with a winning bonus symbol as defined herein. The bonus prize of the present invention is determined separately from any prize in the underlying game or games.

"Designated underlying game" as used herein refers to the underlying game card game or games designated by a manufacturer or a gaming manager to be the game with which the bonus prize is associated.

"Play result" as used herein refers to one of any number of plays on a game card, comprising one or more symbols. The play results may initially be concealed by a concealing device, if required by law or regulation. Players may win a game by obtaining a certain sequence of symbols, matching certain symbols and the like, depending on the specific rules of the underlying game. The symbols relate to one or more variations of games known in the industry.

"Designated play result" refers to a play result on an individual game card, comprising a symbol or set of symbols, that is identified with the bonus prize feature of the present invention. There may be more than one designated play result.

"Concealing device" as used herein refers to any device that conceals the symbols located on a game card. Pull tabs and scratch-off surfaces are two common forms of concealing devices. For a pull tab, removal entails opening the pull tab to display the play result or results underneath the tab. For a scratch-off surface, removal entails scraping off a portion of the surface to display the play result or results underneath the surfaces.

"Symbol" or "symbols" as used herein in describing the present invention refer to alpha or numeric symbols, graphic designations, or any other indicia or combinations thereof, for use on individual game cards and/or master game cards.

"Winning bonus symbol" as used herein refers to the symbol on a master game card or master bonus game card that is identified as associated with the bonus prize feature of the present invention. The winning bonus symbol is made known to the players at some point prior to or after completion of play of the designated underlying game.

It is within the scope of the present invention for any game card game known in the art to comprise the underlying game, and for types of pull tab, seal card, bingo-event, or down-line games other than those specifically described herein to comprise the underlying games. Further, any combination of games known in the art may be utilized, provided at least one is identified as the designated underlying game with which the bonus prize is associated.

The bonus prize feature of the present invention is separate from all underlying game or games, including the designated underlying game, such that, the underlying games, and each level of a multi-level-play, underlying game, is capable of being played to completion, with or without the bonus prize feature of the present invention. The manufacturer or the gaming manager identifies a particular underlying game as the designated underlying game with which the bonus prize will be related. It is identification of the winner or winners of this designated underlying game that determines who is eligible to win the bonus prize. Since the winning bonus symbol is predetermined and made known prior to or after completion of play of the designated underlying game, and the winner of the designated underlying game will already have determined whether she/he has a designated play result that matches the winning bonus symbol, the winning player will be able to determine at the time she/he wins the designated underlying game if she/he also wins the bonus prize: no further play is required, nor is it necessary for the winner of the designated underlying game to make further selections or take additional steps in order to win the bonus prize of the present invention.

If the winner of a designated underlying game does not have a designated play result that matches the winning bonus symbol, the bonus prize is not awarded. In such case, the bonus prize may be carried over into the next game and thereby increase the amount of the subsequent bonus prize.

Examples of Underlying Game Card Games

The following examples of underlying game card games that can be combined with the bonus prize feature of the present invention are illustrative and not intended to limit the scope of the invention.

Pull Tab Games

A basic and popular form of game card game is a pull tab game consisting of a plurality of game cards. Typically, the front side of the game card shows winning combinations of symbols and corresponding prizes a player can win and the back side of the card has concealing devices that conceal symbols for one or more play results. Once exposed, a play result displays the value, if any, of the play. Different types of play results present the values in different formats. For example, a direct play result presents the winning symbol combination directly associated with a prize value, if any.

Seal Card Games

As exemplified in FIGS. 1-4, another example of a game card game is a seal card game which consists of a plurality of game cards 110 each having one or more concealing devices 120 concealing one or more play results 130*a-d*. Seal card games are played in complete sets wherein every game card must be sold or distributed before the seal card game may be played and seal card winner(s) determined. Any number of game cards may be included in a set and manufacturers of seal card games provide sets of all sizes depending on the size needed for the particular event, based on the anticipated number of players.

The individual game cards 110 may be very similar or even identical in format to the pull tab game cards discussed above. As exemplified in FIG. 3, a master game card 140 is provided with each set of seal game cards 110. The master game card 140 may comprise a seal card section 135, a hold section 137, and a depiction of instant winner prizes available 139, although other master game card formats including more or fewer sections are possible. The amount of the seal card prize 147, if any, may also be printed on the front of the master game card 140, with each set of game cards 110 for a seal card game.

Figure 2:
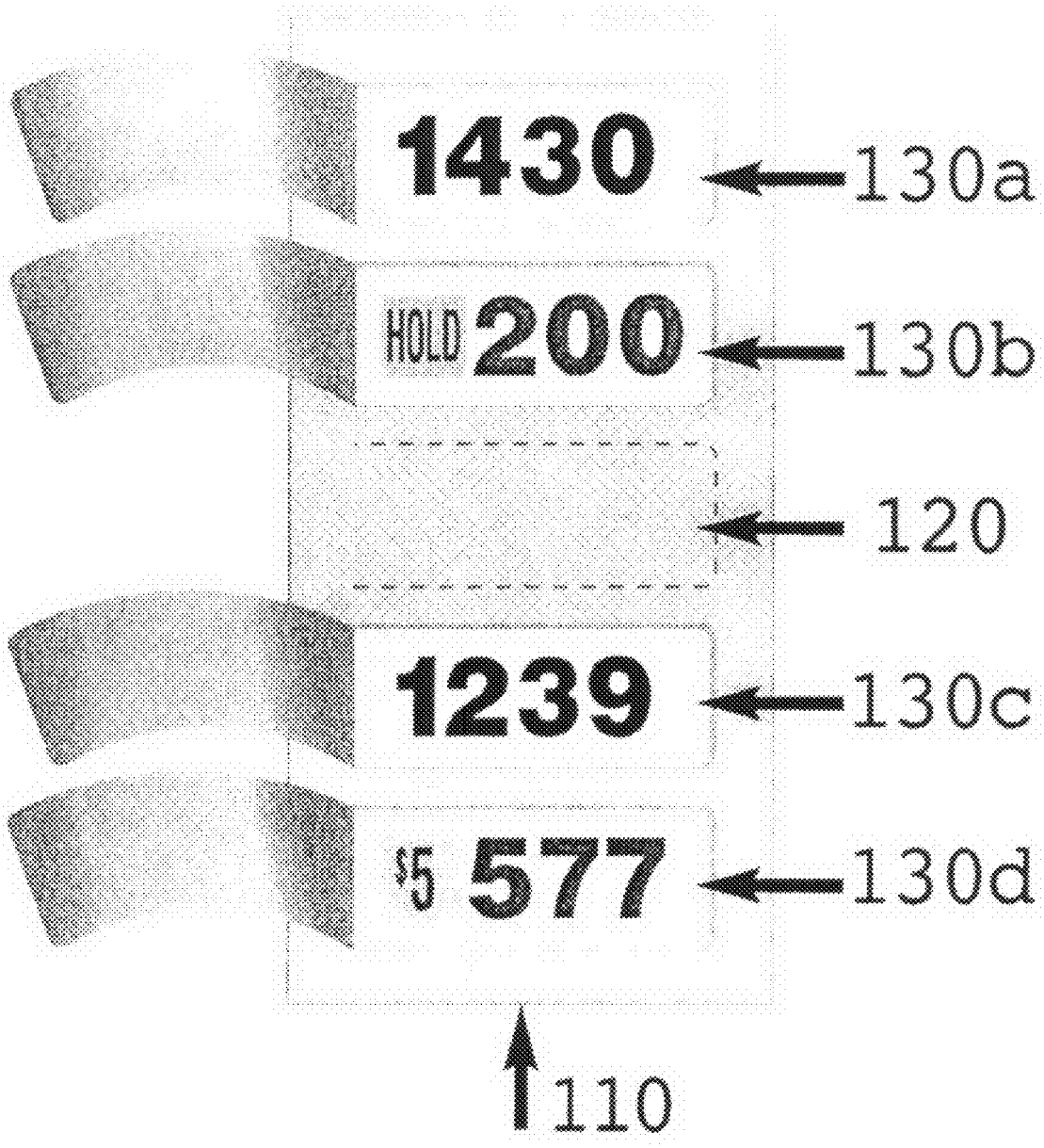
FIG. 2 is a back view of the exemplary game card of FIG. 1 with concealing devices open or closed.

As shown in FIG. 2, in the play of a typical seal card game, a play result 130*a-d* on the game card 110 may be an instant winner 130*d*, or a hold symbol 130*b*, which must match a hold symbol 150 under a concealing device on the master game card 140 to win the hold feature. After the set of game cards 110 are sold out, the hold symbol 150 under the concealing device is revealed. Alternatively, the seal card hold symbol may be revealed before the set is sold out. Either prior to or after the hold symbol 150 under the concealing device is revealed, the players may reveal the play results 130 on their game cards and determine whether any of their play results match the hold symbol 150 and thus whether they win the seal card prize 147, if any.

Figure 3:
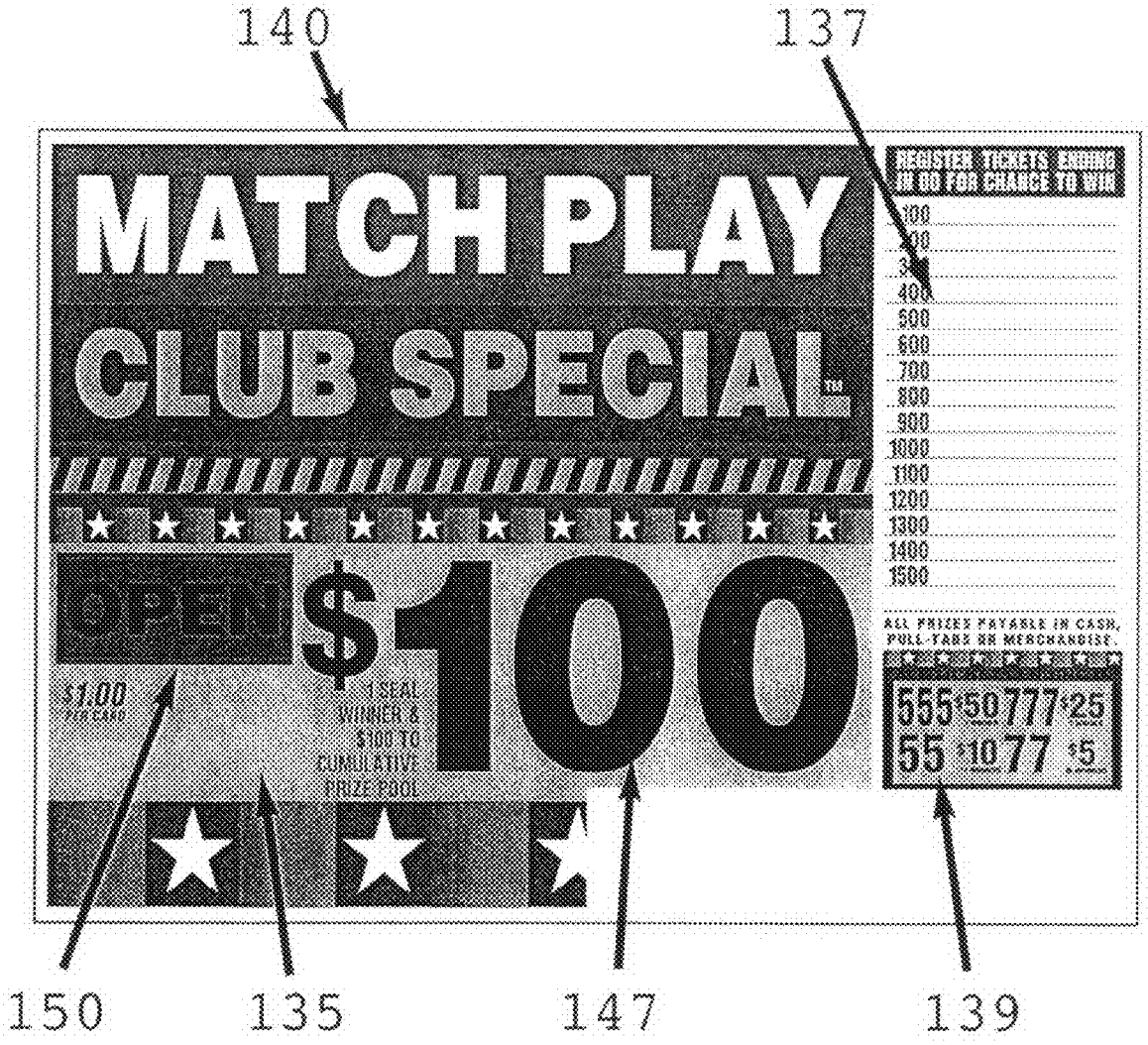
FIG. 3 a front view of an exemplary master game card of the invention for use with the game cards of FIG. 1.

To play the hold section 137 feature, the master game card 140 may provide a location for listing players selected on the basis of such players possessing hold cards containing symbols, such as numbers ending in "00" (FIG. 3). In other variations, the player purchasing the last game card or some other designated position may be listed in a hold section. These players, have a chance to win a prize associated with the hold section 137. There may also be an instant winner section 139 on the master game card 140.

Bingo-Event Game

Yet another example of game card game is a bingo-event game. In a simplified form of a bingo-event game, there are multiple pull tab tickets in a set or deal that are eligible to win a bingo-event prize. These tickets typically correspond with bingo numbers B1 through O75. In the play of a typical bingo-event game, the balls are called as they are drawn and the corresponding numbers on the flashboard are illuminated. "Flashboard" as used herein, refers to a device (usually electronic) that displays the letters and/or numbers called in game cards game, such as bingo game. Typically "illuminated" with or without additional information or graphics. At some point prior to or during play it is announced that a certain ball number drawn will determine the bingo-event prize winner. The ball number may be the first number, last number, next number or any other possible ball number drawn. The player (s) who can match a bingo number on his/her card to an announced bingo number, wins the bingo-event prize.

Figure 5:
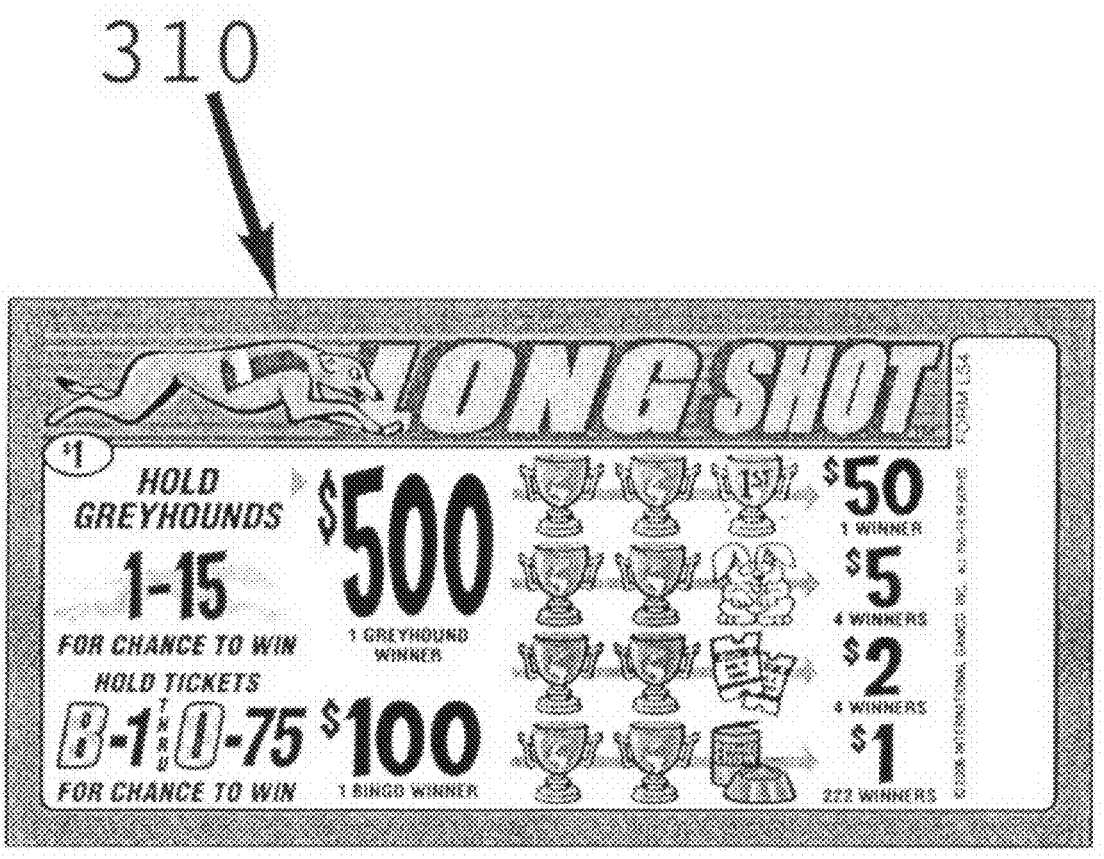
FIG. 5 is a front view of an exemplary game card for use with an embodiment of the present invention, where the designated underlying game is a down-line bingo-event game.
Figure 7:
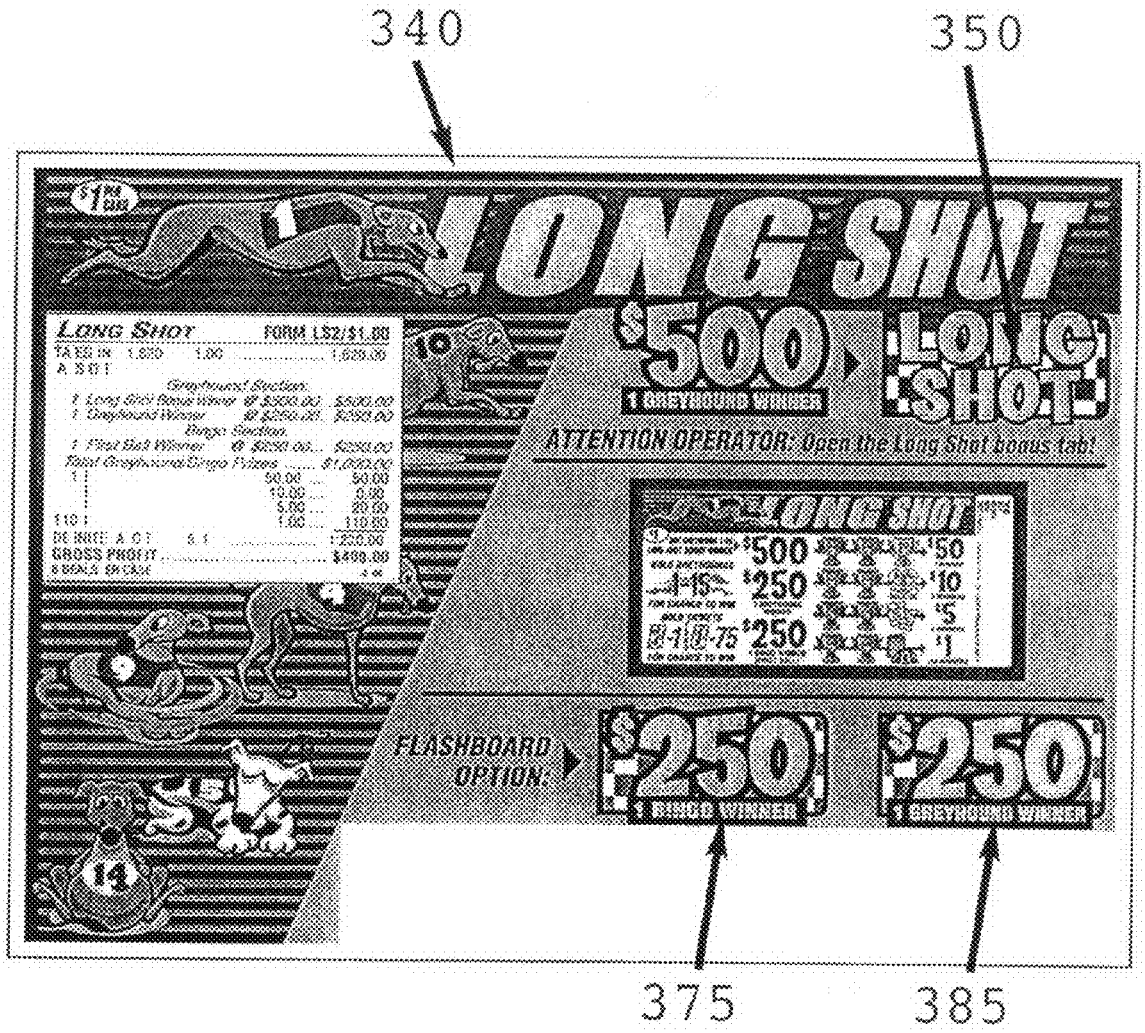
FIG. 7 is a front view of an exemplary master game card of the present invention for use with the game cards of FIGS. 6*a-d*.
Figure 8:
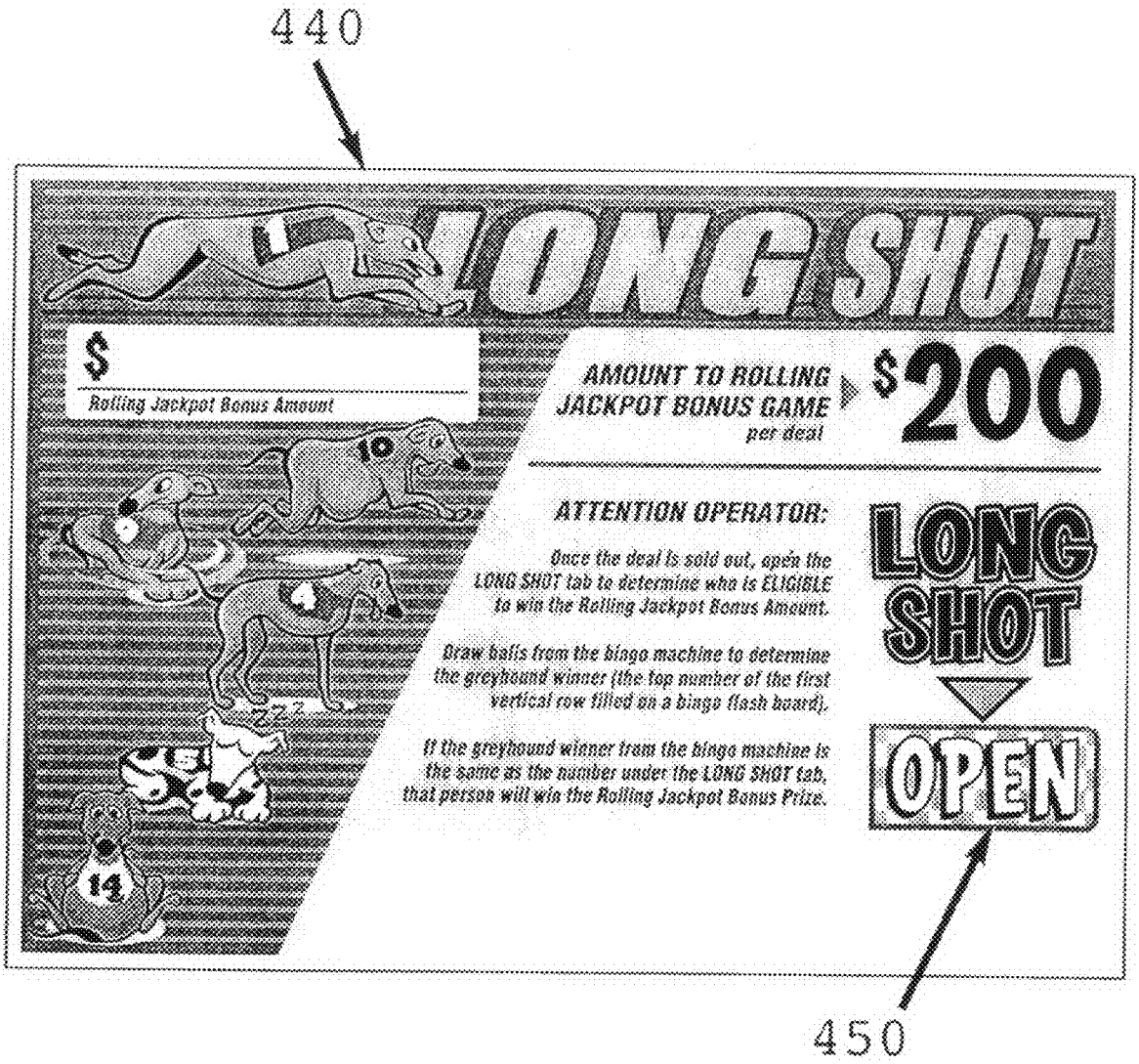
FIG. 8 is a front view of an exemplary master bonus game card of the present invention for use with the game cards of FIGS. 6*a-d*.

Bingo-event games may be played with additional features and prizes. One example is a down-line bingo-event game. In a typical down-line bingo-event game, there are multiple game cards 310 (FIG. 5) in each set that are eligible to win one or more bingo-event prizes. The game cards 310 include hold symbols which correspond to one of the 15 numbers at the top of the vertical columns on a typical flashboard. These are typically referred to as "down-line hold numbers." As exemplified in FIG. 7, the master game card 340 includes a separate down-line concealing device (greyhound winner tab) 385 and bingo concealing device (bingo winner) 375. The down-line concealing device 385 conceals one of the fifteen down-line hold numbers.

In the play of an exemplary down-line bingo-event game, a plurality of game cards 310 are distributed to the players. Three tabs with underlying play results are located on the back side of each game card (FIG. 6*a-d* shows four possible cards). A play result may be an instant winner 330*c*, a non-winner 330*d*, a bingo-event hold symbol 330*b*, or a hold ticket relating to a bingo-event down-line game such as a greyhound race 330*a*.

Figure 6:
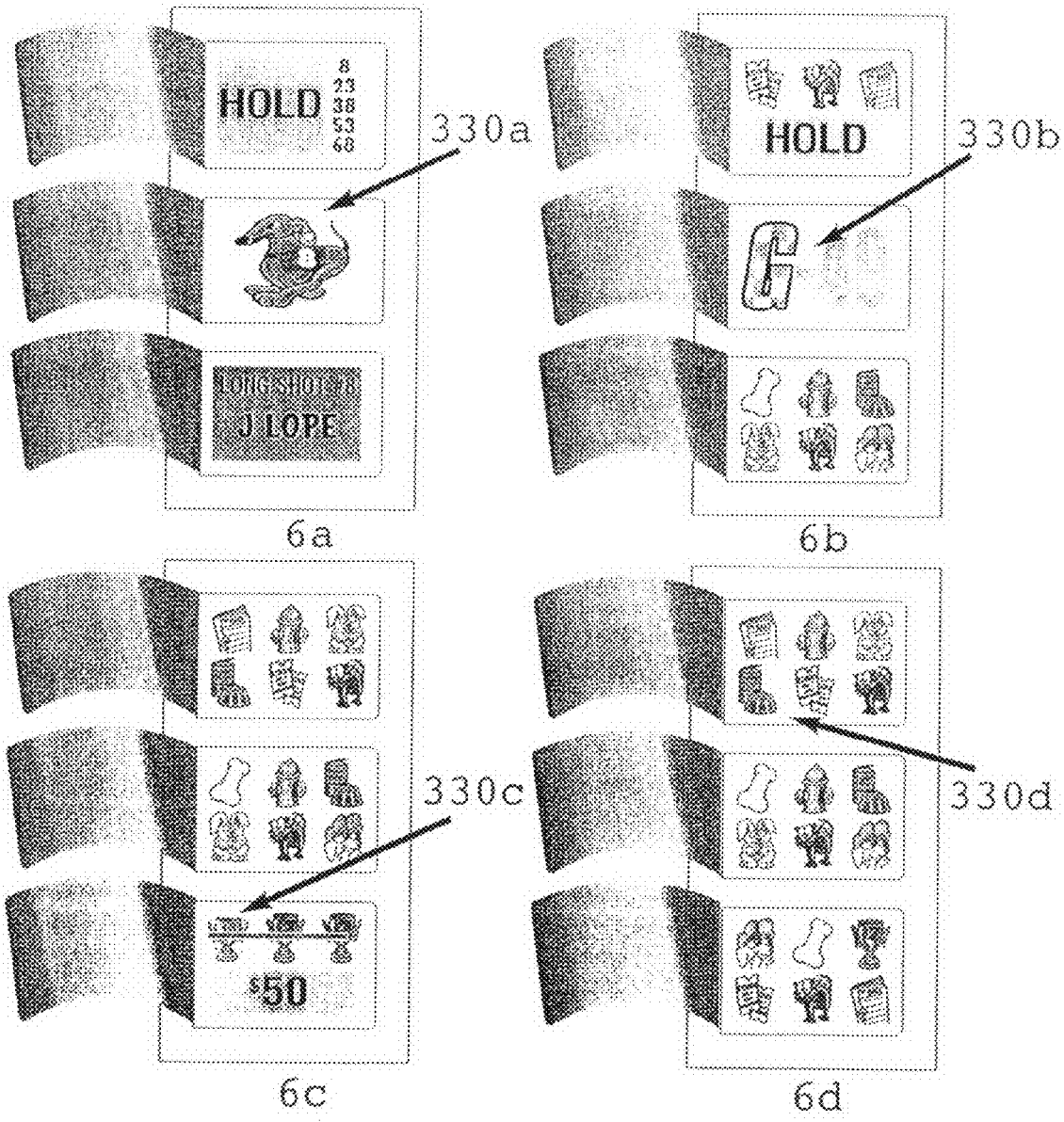
FIG. 6*a-d* are back views of exemplary game cards such as shown in FIG. 5, wherein the concealing devices are open showing possible play results, 6*a-d*.

Every person possessing a game card may be an instant winner and there may be multiple instant winners. For example, when a card has a horizontal row of symbols containing only identical symbols 330*c* or the symbol pattern indicated on the front of the game card as a winning symbol combination, the player holding that card is an instant winner, as shown in FIG. 6*c*.

Typically, in the play of a down-line bingo-event game, once all of the bingo numbers displayed in a vertical column on a flashboard are selected and it is the first such vertical column to be completed, the player in possession of the game card with the corresponding down-line hold number wins the down-line prize. For example, when a typical flashboard is utilized, if a "25" is drawn as the last number to complete a vertical column, the winning down-line hold symbol would be "10". Alternatively, rather than determining the down-line winner by the drawing of bingo numbers and completion of a vertical column on the flashboard, the winning down-line hold symbol may be concealed and displayed on the master game card and revealed during or after the play of the underlying game. The winning down-line hold symbol corresponds to the symbol at the top of the vertical column of a flashboard. The person with a play result of a greyhound displaying the winning down-line hold symbol is the winner of the down-line bingo-event prize. Typically, for entertainment purposes, horses, greyhound dogs and the like are used to simulate a racing event, although other animals or indicia such as cars could be used.

Other variations of the above exemplary may be evident to those skilled in the art of gaming card games are within the scope of the present invention.

EXAMPLES

The following examples of game card games including the predetermined bonus feature of the present invention are illustrative and are not intended to limit the scope of the invention. The figures depict some exemplary game cards, however it should be understood that the format and printed indicia of the game cards are not so limited and may comprise other formats and printed indicia as are known in the art. Similarly, the master game cards shown in the figures are only exemplary and it should be understood that the format and printed indicia of the master game cards is not so limited and may comprise other formats and printed indicia as are known in the art.

Seal Card Game with Predetermined Bonus Feature

Figure 4:
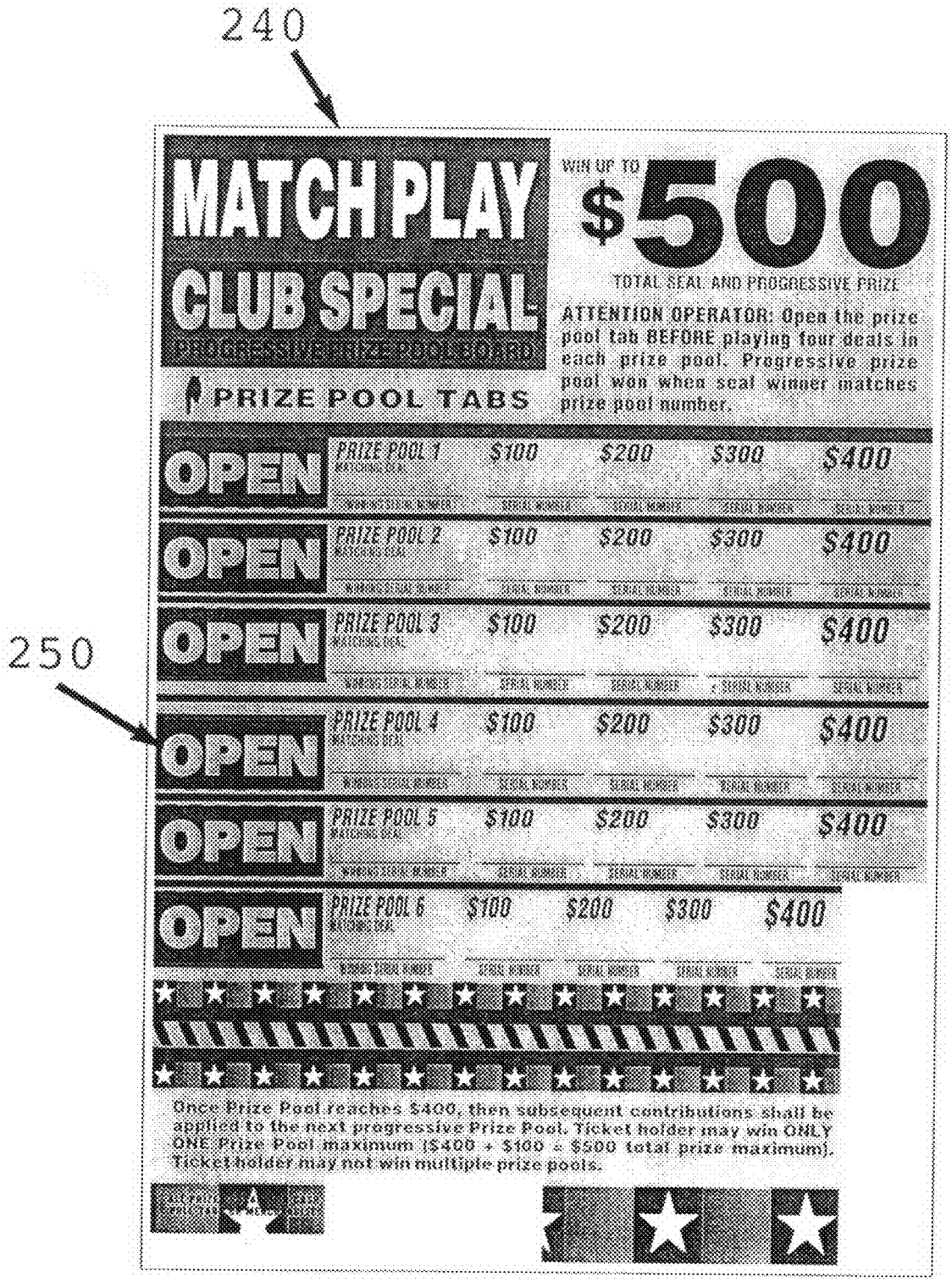
FIG. 4 is the front view of an exemplary master bonus game card of the invention.

In one embodiment of the present invention, the designated underlying game is a seal card game, as discussed above, and shown in FIGS. 1-4. The master game card 140 contains at least one winning hold symbol 150 under a concealing device which must be matched in order for a player to win the seal card game and at least one concealed winning bonus symbol (not shown) that must be matched with a designated play result in order for the player to be eligible to win or share the bonus prize. Alternatively, the winning hold symbol and the winning bonus symbol may be the same symbol. It is also within the scope of the present invention for the winning bonus symbol to be displayed on a separate master bonus game card 240, such as shown in FIG. 4.

In play of this embodiment, the manufacturer or gaming manager identifies the seal card game as the designated underlying game. The gaming manager sells all of the game cards 110 in the game and the players remove the concealing devices 120 to reveal the play results 130. At this point, any instant winner prizes may be paid out.

The gaming manager next opens the bonus window (if provided) or otherwise removes the concealing device, if present, on the master game card 140 or master bonus game card 240 to reveal the winning bonus symbol 250 under the concealing device. The gaming manager may announce the winning bonus symbol (not shown), although a verbal announcement is not required. Alternatively, it is within the scope of the present invention for the winning bonus symbol to be made known prior to selling out the game cards 110, or at any point prior to or after completion of play of the designated underlying game. Once known, the players can immediately determine if they are eligible to win the bonus prize, should they win the designated underlying game.

The seal card game is played to its conclusion as described above. The winner of the seal game is determined and the seal prize, if any, is awarded. If the seal card game winner also has a designated play result 130 on their game card 110 having a symbol that matches the symbol previously made know as the winning bonus symbol, then the player also wins the bonus prize. In one aspect of this embodiment, the winning play result for the designated underlying game is the designated play result, such that the winner of the designated underlying game must be able to match the winning symbol from the designated underlying game with the winning bonus symbol 250 in order to win the bonus prize. In another aspect, all play results on the game card may be designated play results such that the winner of the designated underlying game may win the bonus prize if any of that player's play results 130 match the winning bonus symbol 250.

As described in detail above, in the play of the seal card game, the individual game cards 110 and master game card 140 may also include other games and methods for winning as are known in the art. Such other games may be designated as the designated underlying game instead of the seal card game.

It is within the scope of the present invention for various individual game card and master game card formats to be used and no one particular format is required, provided that a designated play result is contained on an individual game card 110 and a winning bonus symbol is contained on a master game card or a master bonus game card.

Down-Line Bingo-Event Game with Predetermined Bonus Feature

In another embodiment of the present invention, the underlying game is a bingo-event game that is combined with a down-line feature. In this example, the designated underlying game is the down-line feature of the bingo-event game and the down-line game proceeds essentially as described above. At some point prior to conclusion of the down-line game, the gaming manager makes known the winning bonus symbol 350 or 450 on the master game card 340 or 440, respectively. The down-line feature of the bingo-event game is played to its conclusion. If the winning down-line holder's winning symbol is the same as the winning bonus symbol, then that person wins the bonus prize. Alternatively, it is within the scope of the present invention for winner of the down-line game to win the bonus prize if s/he has any play result that matches the winning bonus symbol 350 or 450, even if that symbol was not the winning symbol for the designated underlying game.

As discussed in detail above, if the down-line winner cannot match the winning bonus symbol, the bonus prize may not be paid out or may be rolled over to the next game (progressive style). The winning bonus symbol located on the master game card or master bonus game card may be used only once per deal or it may be carried over as the bonus prize carries over. The bonus prize amount may be located on the same master game card as used in previous games in the progressive series. It is also within the scope of the present invention for additional winning bonus symbols to be added to existing winning bonus symbols during successive games such that if a gaming venue were playing from a single master bonus game card (not shown) with 15 bonus windows, they would open a new window from game to game, effectively increasing the odds of hitting the rolling bonus prize. Any prize won may be split between the winners, if more than one winner was identified. Other prize-splitting variations may also be employed and are within the scope of the present invention.

While specific embodiments have been shown and discussed, various modifications may of course be made, and the invention is not limited to the specific forms or arrangement of parts and steps described herein, except insofar as such limitations are included in the following claims. Further, it will be understood that certain features and sub combinations are of utility and may be employed without reference to other features and sub combinations. This is contemplated by and is within the scope of the claims.

What is claimed is:

1. A gaming system, comprising one or more underlying game card games and a predetermined bonus prize feature, said gaming system further comprising:

a. an underlying game card game identified as a designated underlying game;

b. one or more individual game cards;

c. one or more of said individual game cards comprising a designated play result, other than an instant winner symbol;

d. a master game card or master bonus game card comprising a predetermined winning bonus symbol; and e. bonus prize instructions, wherein the winning bonus symbol is identified and made known to all players prior to completion of play of the designated underlying game, and the bonus prize instructions direct that award of the predetermined bonus prize is contingent upon a winning player of the designated underlying game being able to match a designated play result on the winning player's game card with the winning bonus symbol.

2. The gaming system of claim 1, wherein the designated underlying game is a seal card game.

3. The gaming system of claim 1, wherein the designated underlying game is a bingo-event game.

4. The gaming system of claim 1, wherein the designated underlying game is a down-line bingo-event game.

5. The gaming system of claim 1, wherein the bonus prize is carried over to a subsequent designated underlying game if not awarded.

6. The gaming system of claim 1, wherein the bonus prize is not carried over to a subsequent designated underlying game if not awarded.

7. The gaming system of claim 1, further wherein the designated play result is used in play of the designated underlying game.

8. The gaming system of claim 1, further wherein the designated play result is not used in play of the designated underlying game.

9. The gaming system of claim 1, further wherein the winning bonus symbol is made known prior to beginning play of the designated underlying game.

10. The gaming system of claim 1, further wherein the winning bonus symbol is made known prior to or during distribution of the individual game cards.

11. The gaming system of claim 1, wherein the bonus prize is retained by the individual player who wins the designated underlying game.

12. The gaming system of claim 1, wherein the bonus prize is shared between the individual player who wins the designated underlying game and other individual players of the gaming system.

* * * * *